United States Patent [19]

Walther et al.

[11] 4,428,161

[45] Jan. 31, 1984

[54] ANNULAR TROUGH-SHAPED VIBRATING SCOURING CONTAINER

[75] Inventors: Carl K. Walther, Wuppertal; Hubert P. Hagelüken, Düsseldorf; Karl Temme, Wuppertal, all of Fed. Rep. of Germany

[73] Assignee: Carl Kurt Walther GmbH & Co. KG, Wuppertal, Fed. Rep. of Germany

[21] Appl. No.: 206,926

[22] Filed: Nov. 14, 1980

[30] Foreign Application Priority Data

| | | | |
|---|---|---|---|
| Nov. 17, 1979 | [DE] | Fed. Rep. of Germany | |
| Jul. 2, 1980 | [DE] | Fed. Rep. of Germany | 3024982 |
| Oct. 13, 1980 | [EP] | European Pat. Off. | 80 106216.7 |

[51] Int. Cl.[3] ..... B24B 31/06

[52] U.S. Cl. ..... 51/163.2

[58] Field of Search ..... 51/7, 163.1, 163.2, 51/164.1

[56] References Cited

U.S. PATENT DOCUMENTS

| | | | |
|---|---|---|---|
| 3,771,266 | 11/1973 | Kobayashi | 51/163.2 |

FOREIGN PATENT DOCUMENTS

| | | | |
|---|---|---|---|
| 1584794 | 3/1972 | Fed. Rep. of Germany | 51/163.2 |
| 2346704 | 3/1975 | Fed. Rep. of Germany | 51/163.2 |
| 2425094 | 4/1975 | Fed. Rep. of Germany | 51/163.2 |
| 2178387 | 10/1973 | France . | |
| 52-47701 | 1/1977 | Japan | 51/163.1 |
| 492518 | 8/1970 | Switzerland . | |

*Primary Examiner*—Harold D. Whitehead
*Attorney, Agent, or Firm*—Martin A. Farber

[57] ABSTRACT

A vibrating abrasive container is formed with track-line which lies in a plane running at an acute angle to the horizontal and therefore at an acute angle to the vertical axis of the vibration generator, in such a manner that the uppermost and lowermost points face each other approximately diametrically, thereby causing a spirally circulating processing movement of the contents of the container to take place on the descending section of the container.

13 Claims, 15 Drawing Figures

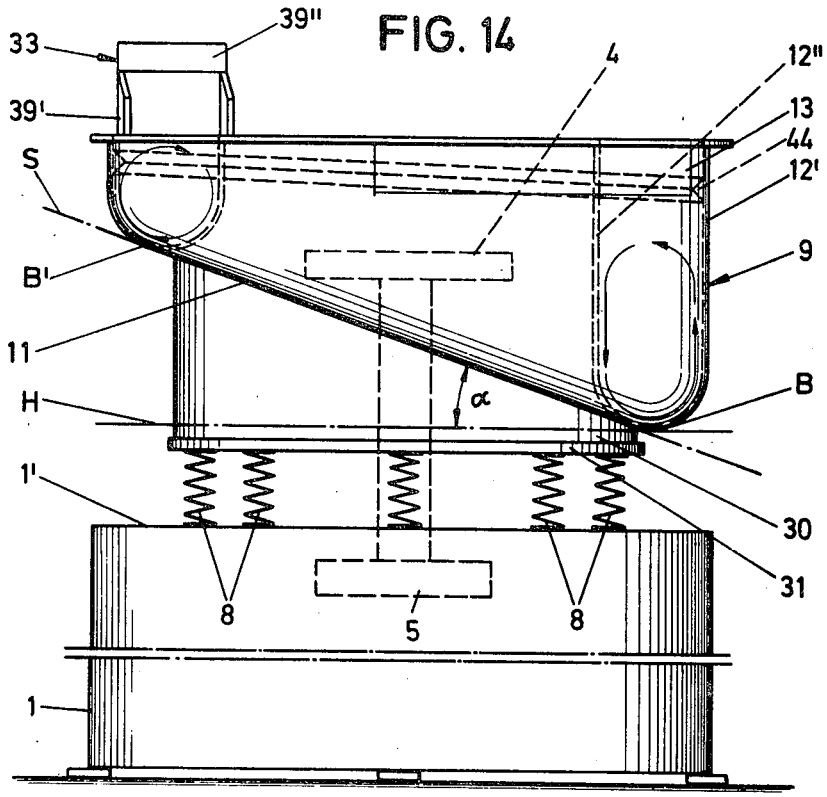
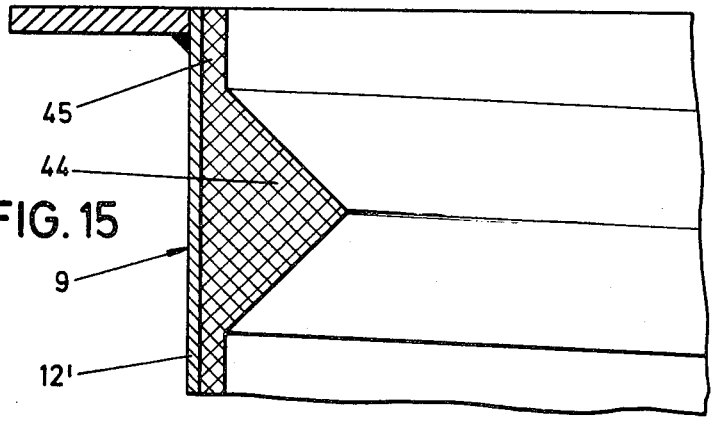
FIG. 15

ANNULAR TROUGH-SHAPED VIBRATING SCOURING CONTAINER

FIELD OF THE INVENTION

The invention relates to an annular, trough-shaped, vibrating abrasive container for abrasive finishing of workpieces in the container, the abrasive container being resiliently, mounted on a machine frame, the container comprising upwardly directed lateral walls defining a container channel therebetween, with an ascending bottom section and a descending bottom section of the channel which ascends and descends respectively in the peripheral direction of the container channel in a downstream direction in which the contents of the container are conveyed, the contents, as a result of oscillating movement produced by centrifugal weights rotating about a vertical axis, being able to move along the ascending bottom section in a sprial path.

PRIOR ART

Vibrating abrasive containers are known (German OS 19 57 547) in which the highest apex or container-bottom is in the form of a spiral. The summit of the container is connected to the lowermost beginning thereof by a falling step. Workpieces and elements to be processed are conveyed upwardly to the end of the container, from where they fall to the lowermost beginning thereof. A drop step of the kind, however, may lead to damage, especially if the workpieces are fragile. This falling step also reduces the output of the machine.

In other designs (French Patent 2,178,387, Publication No.), the container and the vibration-generator may be tilted to accelerate emptying through an aperture arranged after the falling step. The unit cannot operate in this tilted position since, because the vibration-generator is also tilted, there would be no spiral circulation of the contents of the container. Furthermore, the falling step produces the problems mentioned above.

In still other containers (Swiss Patent No. 492 518), upward conveying is carried out in a plurality of individual arcuate sections. A linear horizontal section is located between each two arcuate sections. After the last arcuate section, a crest is formed, after which the bottom of the channel again follows a descending path and opens into the lowermost beginning of the container. Since the material is conveyed upwardly, if possible to a very much higher level, the path of descent, because of its steepness, is the equivalent of a falling step. Thus the contents of the container slides down and no surface-processing takes place.

OBJECT

In contrast to the foregoing, it is the purpose of the invention to design an annular, trough-shaped, vibrating abrasive container, of the type mentioned at the beginning hereof, which is simple to produce and more convenient to use, in such a manner that a grinding operation takes place also in the descending channel-section also.

SUMMARY OF THE INVENTION

This objective is achieved by the invention in the manner that the descending bottom section (11") extends over an angle of essentially 180° of the container, and the lateral walls of the container channel, even in the area of a lowermost beginning (B) of the bottom sections, extend upwardly higher than an uppermost apex (B') of the bottom sections of the container channel.

This formation provides a vibrating abrasive container, of the introductory-mentioned, type with increased serviceability. There is no longer a falling step between the summit and the lowermost beginning, and this permits gentle processing of the workpieces. The long, continuously descending course of the remainder of the containerbottom is such that circulation and processing abrasive finishing takes place as the contents of the container are dissaggregated. It was found that this shortens surface-processing times.

The plan view shape of the annular, trough-shaped, vibrating abrasive container may vary, for example the annular abrasive container may be circular, oval, egg-shaped or square. Herein the term "annular" includes all these possibilities and in general is defined herein as a closed ring channel. The container bottom always includes an ascending section and a descending section of approximately the same length. Handling is also improved. The track or trace line of the bottom lies in one plane and this is at an acute angle to the horizontal. However, the axis of the vibration-generator is still vertical, thus producing a satisfactory spiral circulation. The container-bottom has no projecting unevenness. This also facilitates production. Optimal processing results are obtained when the slope of the plane is about 20°.

BRIEF DESCRIPTION OF THE DRAWINGS

With the above and other objects and advantages in view, the present invention will become more clearly understood in connection with the detailed description of preferred embodiments, when considered with the accompanying drawings, of which:

FIGS. 14 and 15 show the same design as in FIG. 8, but with an annular bead projecting into the channel-area.

DETAILED DESCRIPTION

Figure 1:
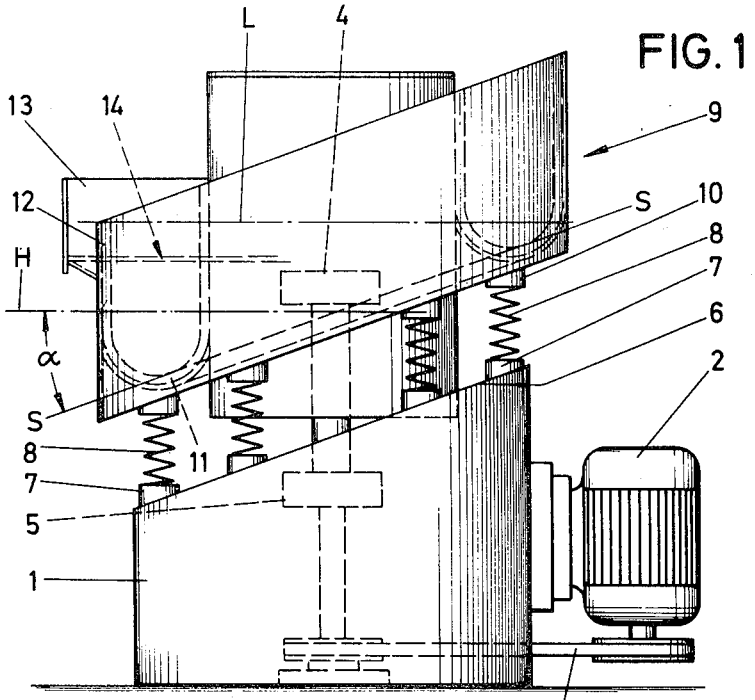
FIG. 1 is a side elevation of a vibrating abrasive container having a circular ground-plan, mounted upon the sub-frame of a machine.

The vibrating abrasive finishing machine illustrated in FIGS. 1–5 comprises a sub-frame 1, of circular shape in plan view, with a drive-motor 2 secured to the periphery. Centrifugal eccentric-weight masses 4,5, in the form of segmental discs, are driven off-set in rotation by means of a belt 3.

The sub-frame 1 has an upper surface 6 inclined at an acute angle to the horizontal and carrying small suports 7 in equal angular distribution. Compression springs 8, of approximately equal length, are mounted between the supports 7 and similar supports 10 on container 9, carry the container.

The vibrating abrasive container 9 is of circular shape in plan. Track-line S of the container-bottom 11 runs in a plane arranged at an acute angle alpha amounting to about 20°. This plane is therefore also at an acute angle to the axis of the centrifugal weights 4,5.

The container is of U-shaped cross-section forming the container channel or trough. The height of lateral wall 12 of the channel extends, in the lowermost beginning B, above the level of the track-line S at the uppermost summit B'. This is shown by horizontal a bottom section 11' ascending from the lowermost container beginning B to.

As a result of this formation, the vibration abrasive container has a bottom-section 11' ascending from a lowermost container-beginning B to an uppermost container-apex (hereinafter referred to as the summit) B', and a bottom section 11" running from the summit B' to the lowermost beginning B. Since the track-line S runs in one plane, the ascending and descending angles are equal.

The centrifugal eccentric-weight masses 4,5 cause the container-content to circulate while spiraling and to ascend from the lowermost beginning B to the summit B' in the direction of arrow y. However, the descending section 11" of the container is also a processing section with this circulating effect.

A discharge aperture 13 is provided in the lower most area.

In the vicinity of the lowermost container-beginning B, the vibrating abrasive container 9 is equipped, in the area of the descending bottomsection 11", with a discharge-spout 13 arranged as a secant with respect to the circular shape of the container channel. Associated with this is a discharging and separating device 14 in the form of a circular section, concentric with the center or origin M of the container displaceable in the direction of the summit B', and lying horizontally. The circular section is a separating screen 15 having a ramp 16 directed upstream toward the summit B'. The other end of the screen forms a vertical end-wall 17 extending between the inner and outer walls of the container.

Figure 4:
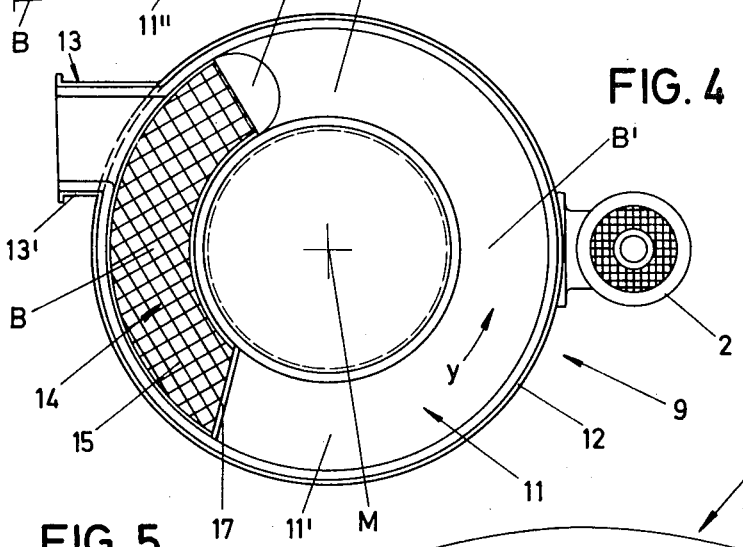
FIG. 4 is a view corresponding ti that in FIG. 2, but with the discharging and separating device inoperative.
Figure 5:
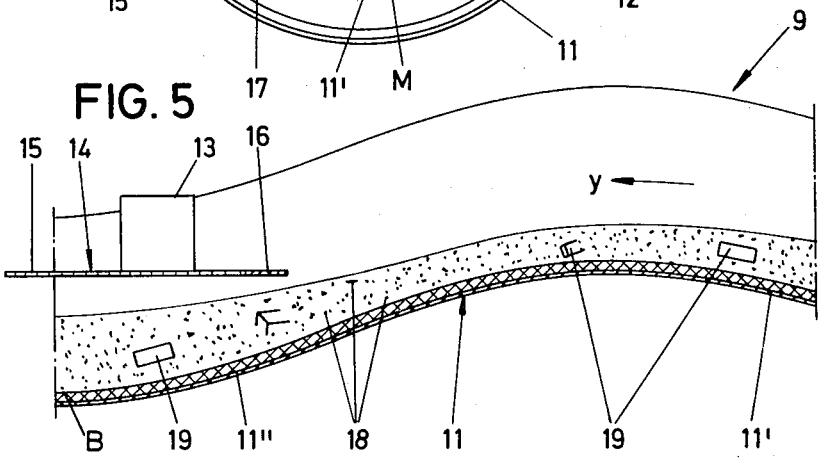
FIG. 5 shows a development relating to FIG. 4.

If the contents of the container, consisting of processing elements 18 and workpieces 19 pass several times through the container during processing, screen 15 is set to the position shown in FIGS. 4 and 5. This results in the contents of the container being conveyed upwardly in the area of the ascending bottom-section 11'. After reaching the summit B', the contents of the container pass down the processing section which descends continuously to the lowermost beginning B and are at the same time disaggragated. FIG. 5 shows that the container contents then pass under the separating screen. FIG. 5 also shows that the spiraling of the contents of the container have a maximum extent in the lowermost beginning B.

Figure 2:
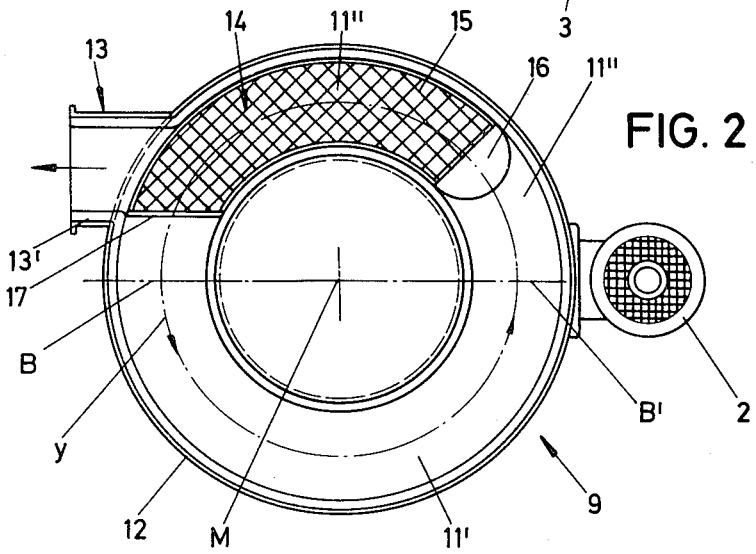
FIG. 2 is plan view of the vibrating abrasive container with the discharging and separating device in the discharge position.
Figure 3:
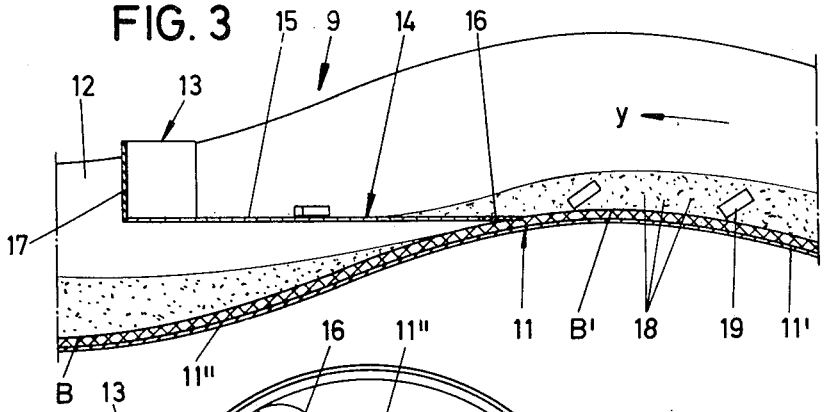
FIG. 3 is a diagrammatical representation of a development of the vibrating abrasive container, with the discharging and separating device in operation.

The workpieces 19 are to be discharged, after surface-processing, separating screen 15 must be shifted to the position shown in FIGS. 2 and 3. This may be achieved manually or by means of a motor. In this connection, end 16 of the separating screen 15 facing the conveying-direction y abuts the channel-bottom 11 immediately downstream of the uppermost apex B'—see FIG. 3. In this position, the end wall 17 of the separating screen 15 forms an extension of the lateral wall 13' of the discharge-spout. The contents of the container therefore reach the separating screen 15. Processing elements 18 pass through the screen, while the workpieces 19 are retained on the screen and discharged.

Figure 6:
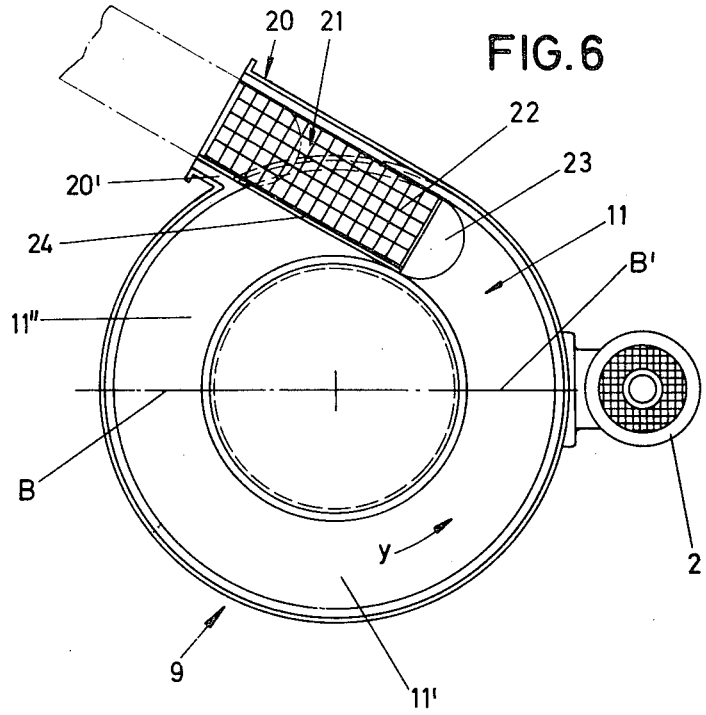
FIG. 6 is a plan view of the vibrating abrasive container according to the second embodiment housing a tangential discharge-slide.
Figure 7:
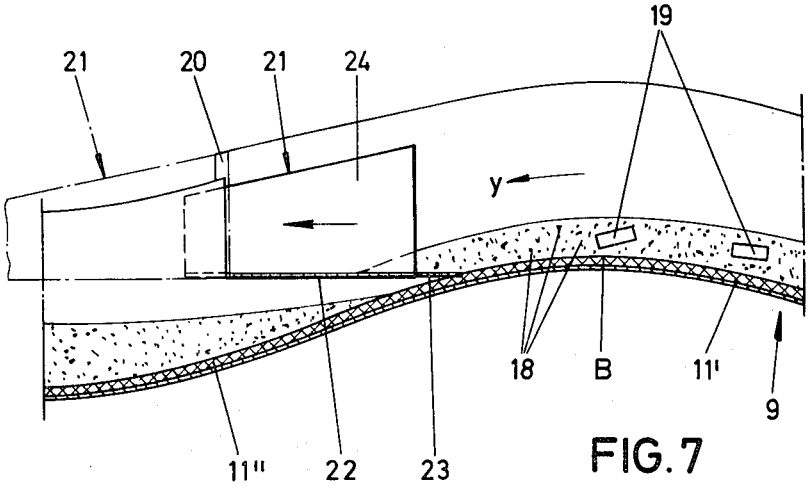
FIG. 7 shows a development of the vibrating abrasive container of FIG. 6, with the discharge-slide arranged tangentially.

In the embodiment illustrated in FIGS. 6 and 7, dischargespout 20 is arranged tangentially, extending above the descending containerbottom 11". Spout 20 carries a discharge-slide 21 in the form of a separating screen 22. In the discharging shown in FIG. 6, the end 23, which is in the form of a ramp facing upstream of the conveying-direction y, is seated upon channel-bottom 11 shortly downstream of uppermost summit B'. Screen 22 is also equipped with a vertical wall 24 which, in the discharging position, is an extension of the shorter lateral wall 20' of the discharge-spout 20. When the discharge-slide 21 is operative, separation takes place between the workpieces 19 and processing elements 18.

If the contents of the container are to circulate repeatedly, the dischargeslide is to be withdrawn, as shown in FIGS. 6 and 7 in dash dotted lines.

According to another embodiment, not shown, the separating screen is inserted from above into the vibrating abrasive container, instead of being displaceable concentrically with respect to the center of the container.

It will be seen that the upper centrifugal weight 4 is located in the interior of the circular vibrating abrasive container 9, while the lower centrifugal weight 5 is located in the upper part of the machine sub-frame 1.

Figure 8:
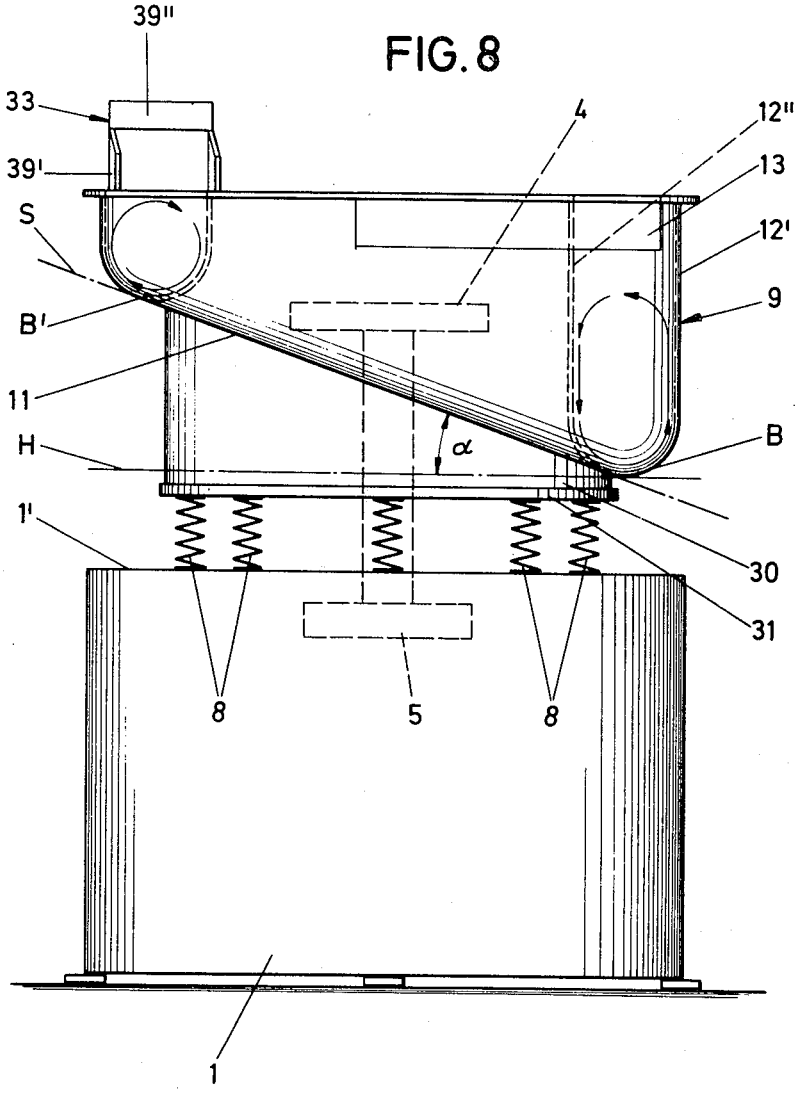
FIG. 8 is a view of a vibrating abrasive container, mounted upon the sub-frame of a machine, according to another embodiment.

In the embodiment according to FIG. 8, the cross-sectionally U-shaped vibrating abrasive-container channel is such that the height of the channel, in the lowermost area B of the transversely arched bottom 11, is approximately twice that in the uppermost area or apex B' of the container. In this connection, the height of the channel in the uppermost area B' corresponds approximately to the width of the channel, of FIG. 8.

The lateral walls 12', 12" which extend from the container-bottom 11, are dimensional such that they extend, in the lowermost area, approximately as far as the upper edge of the lateral walls provided in the uppermost apex B' of the container. That is the upper edge of the container is arranged in a horizontal plane. Moreover, the lateral walls 12', 12" of container 9 are parallel to each other and vertical.

Since the track-line S runs at an angle to the horizontal H and in one plane, this vibrating abrasive container also has a bottom-section 11' ascending from the lowermost container-beginning B to the uppermost container-apex B', and a bottom section 11" descending from the uppermost apex B' to the lowermost area or beginning B. The angles of ascent and descent are equal.

Figure 9:
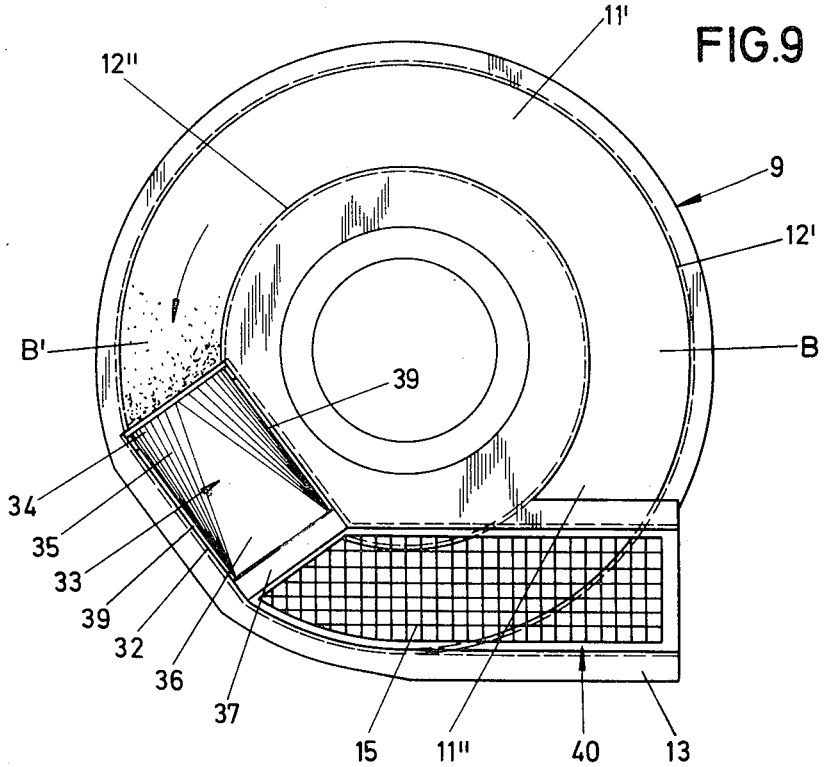
FIG. 9 is a plan view of this vibrating abrasive container of FIG. 8, with the flap in the discharge position.

Immediately downstream of the uppermost area B', i.e. in the descending bottom section 11'', the abrasive-container channel changes to a straight section 32, with a somewhat expanded cross-section. Located in this straight section 32 is a flap 33 having an end-section 34 which faces upstream of the direction in which the container-contents are conveyed and matches the section 32 in accordance with the curvature in the bottom of the container-channel. In this connection, the edge of end-section 34 is arranged as a secant to the circular shape of the container, of FIG. 9. Arched surfaces 35, extending from the end-section 34, merge into a plane 36 immediately before the horizontal axis of flap 33. The axis of the flap, adjacent plane 36, is in the form of a film-hinge-zone 37, the flap being secured, on the other side of zone 37, to a transverse stud 38 in the channel of the vibrating abrasive container. Both the transverse stud 38 and the film-hinge-zone 37 are arranged as secants to the circular configuration of the container.

Figure 10:
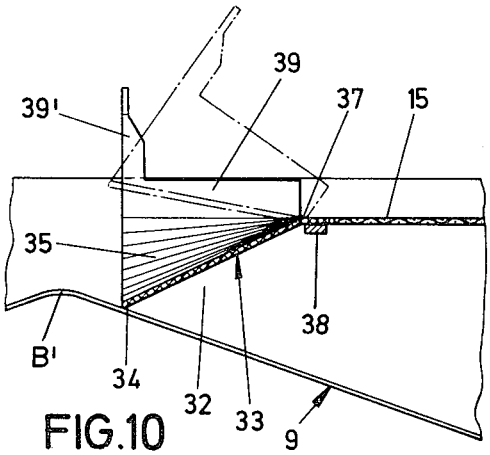
FIG. 10 illustrates, in diagrammatical form, a detail of the development of this vibrating abrasive container of FIGS. 8 and 9, in the uppermost area, with the flap set to the discharge position.
Figure 11:
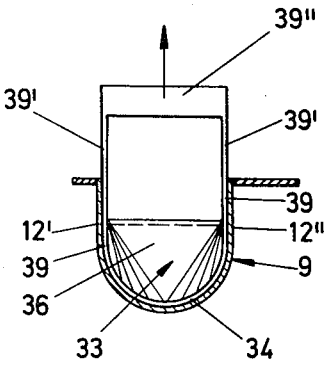
FIG. 11 is a cross-section of the container of FIG. 10 through the container channel immediately in front of the flap.

In the discharge position, the bottom surface of the flap 33 is inclined as shown in FIG. 10. The transverse arching of the flap continues into upwardly directed lateral walls 39 which, when the flap is in the discharge position, terminate on a level with the upper edge of the container 9. In the vicinity of the endsection 34, the lateral walls 39 are extended in the form of webs 39' projecting beyond the container 9 and connected together by a yoke 39'' with which a flap-actuating device, not shown, may engage.

Adjoining the flap 33 and the transverse web 38 respectively is a discharge-section 40 which is arranged as a secant in relation to the circular configuration of the vibrating abrasive container, this section terminating in a discharge spout 13. Located in the discharge-section 40, on a level with the transverse stud 38, is a separating screen 15. Both the latter and the section 40 extend at an obtuse angle relative to the straight section 32 which accomodates the flap 33.

If the contents of the container are to pass repeatedly therethrough, for the purpose of processing the workpieces, the flap 33 must be pivoted into the position shown in dashed-dotted lines in FIG. 10. For discharging the contents, the flap 33 is moved in the downward direction, whereupon the arched end-section 34 sits on the bottom surface of the abrasive container channel. Thus the contents of the container, arriving from uppermost apex B' of container bottom 11, run onto the flap 33, where they advance spirally over a certain distance, and then pass to the separating screen 15. The processing elements pass through the screen, whereas the workpieces are discharged.

As illustrated by the curved arrows in FIG. 8, the height of the spiral in the lowermost beginning B is about twice that in the uppermost apex B'. Thus, during processing the contents of the container in the uppermost apex B' attain a higher velocity with simultaneous disaggregation. In other words, the pitch of the spiral increases in the uppermost apex B'. The continuous change in the cross-section of the spiral varies the pressure and velocity of the container-contents, and this increases the amount of material processed.

Figure 12:
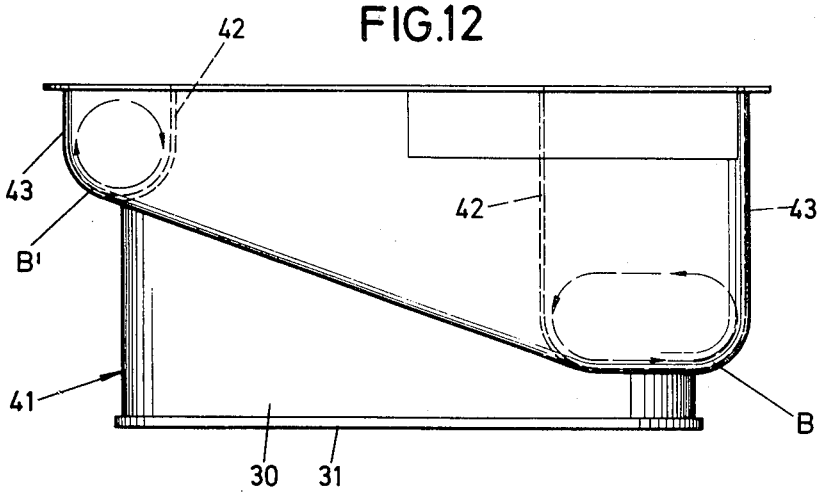
FIG. 12 is a view of a vibrating abrasive container according to a further embodiment.
Figure 13:
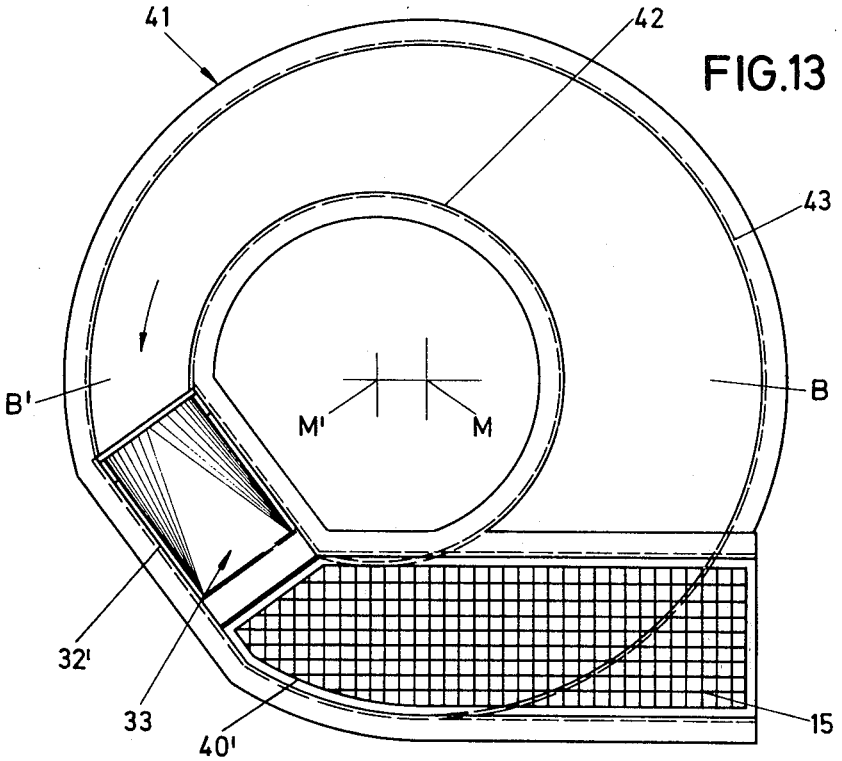
FIG. 13 is a plan view of this vibrating abrasive container of FIG. 12.

In the case of the embodiment according to FIGS. 12 and 13 of a vibrating abrasive container 41, the width of the channel in the lowermost beginning B is greater than in the uppermost apex B', the ratio in this case being about 2:1. In FIG. 12, the cross-sectional shape of the spiral in these areas is indicated with dashed arrows.

In this formation there is a continuous decrease in width from the lowermost beginning to the uppermost apex B'. This shape is achieved by forming the inner and outer walls 42,43 of the channel as circles over almost their entire circumferential length with origins M and M' off-set in relation to each other.

A straight section 32' also follows the uppermost apex B' and serves to accommodate a flap 33. This is followed by discharge-section 40', also arranged as a secant in relation to the circular shape of container 41.

In this formation, lateral walls 42,43 of the channel are arranged entirely vertically.

In the embodiment illustrated in FIGS. 14 and 15, which closely resembles that shown in FIG. 8, similar parts bear the same reference numerals. In contrast to the embodiment illustrated in FIG. 8, the interior surface of the outer wall 12' of the channel comprises an annular bead 44 projecting, in the vicinity of the upper edge, into the interior of the channel, and extending in an approximately horizontal plane, the bead being of triangular cross-section and being obtained by thickening the lining 45 of the container and being made of rubber or of a suitable synthetic material.

While we have disclosed several embodiments of our invention it is to be understood that these embodiments are given by example only and not in a limiting sense.

We claim:

1. In an annular trough-shaped vibrating abrasive container for abrasive finishing of workpieces in the container, the abrasive container being resiliently mounted on a machine frame, the container comprising upwardly directed lateral walls defining a container channel, the container therebetween, with an ascending bottom section and a descending bottom section of the channel which ascends and descends respectively in the peripheral direction of the container channel in a downstream direction in which the contents of the container are conveyed, the contents moving along the ascending bottom section in a spiral path, the improvement wherein the descending bottom section extends over an angle of substantially 180° of the container channel, and said lateral walls of the container channel in the area of a lowermost portion of the bottom sections of the container channel defining a lowermost beginning of said container channel, extend upwardly higher than an uppermost portion of the bottom sections of the container channel defining an uppermost apex of the bottom sections of said container channel.

2. The vibrating abrasive container according to claim 1, wherein the bottom sections of the container channel define a minimum point track-line which runs in one plane oriented at an acute angle of inclination relative to the horizontal, and said acute angle of inclination is substantially 20 degrees, and said lateral walls define an upper edge and adjacent the lowermost beginning of said container channel said lateral walls project upwardly and extend approximately to the level of the upper edge of said lateral walls adjacent the uppermost apex.

3. The vibrating abrasive container according to claim 1, wherein the lateral walls and said bottom sections define said channel, the height of the channel in the vicinity of the uppermost apex corresponds approximately to the width of the channel thereat, and the width of the channel in a vicinity of the lowermost beginning is greater than the width of the channel in vicinity of the uppermost apex.

4. The vibrating abrasive container according to claim 3, wherein the width of said channel continuously reduces up to said vicinity of the uppermost apex in the direction of conveyance of the contents in the channel, said lateral walls constitute an inner wall and an outer wall of said channel, said inner and outer walls of the channel are circular in cross-section over substantially their entire circumferences and have origins respectively off-set relative to each other.

5. The vibrating abrasive container according to claim 1, wherein said lateral walls are parallel to each other and vertical.

6. The vibrating abrasive container according to claim 1, wherein said ascending bottom section and said descending bottom section have a substantially circular annular shape, said descending bottom section descends in the downstream direction of conveyance of the contents and has a straight section thereof interrupting said circular annular shape, a discharge section extends at an obtuse angle relative to said straight section and as a secant relative to said circular annular shape, a flap means is mounted in said straight section for actuating said discharge section.

7. The vibrating abrasive container according to claim 1, wherein said machine frame includes a sub-frame having an upper surface, springs, said container is carried by said springs, said springs are substantially equal to one another in length, said springs are seated upon said upper surface of said sub-frame, said upper surface extends at an acute angle relative to the horizontal.

8. The vibrating abrasive container according to claim 1, wherein said container has a circular cross-sectional shape defining an origin, a discharge spout is arranged as a secant relative to said circular cross-sectional shape of said container and communicates with the descending bottom section adjacent the lowermost beginning of the container channel, a discharging and separating unit between said lateral walls extends in the downstream direction away from the uppermost apex, said discharging and separating unit has the shape of a circular section and is displaceable concentrically around said origin of said container in an upstream direction towards a vicinity of said uppermost apex in said discharge position of said unit and in the downstream direction away from said vicinity of the uppermost apex in a non-discharge position of said discharging and separating unit, respectively, said discharging and separating unit has an end portion formed with an end wall, said end portion in said discharge position of said unit is positioned adjacent said discharge spout, said unit has an end facing the upstream direction, said end engages the descending bottom section slightly downstream of the vicinity of said uppermost apex in the discharge position.

9. The vibrating abrasive container according to claim 8, wherein said discharging and separating unit is horizontal, said end wall extends between said lateral walls.

10. The vibrating abrasive container according to claim 1, wherein the lateral walls constitute an inner wall and an outer wall defining said channel therebetween, said outer wall has an interior surface comprising, in a vicinity of an upper edge thereof, a cross-sectionally triangular annular bead projecting into the interior of said channel and extending in a substantially horizontal plane.

11. The container according to claim 1, wherein the inclination of the ascending bottom section as well as of the descending bottom section is approximately 20°.

12. The container according to claim 1, further comprising means for oscillating said container comprising a substantially vertical axle, and centrifugal weights rotatably mounted about said vertical axle.

13. The container according to claim 11, further comprising means for oscillating said container comprising a substantially vertical axle, and centrifugal weights rotatably mounted about said vertical axle.

* * * * *

UNITED STATES PATENT AND TRADEMARK OFFICE

CERTIFICATE OF CORRECTION

PATENT NO. : 4,428,161

DATED : January 31, 1984

INVENTOR(S) : Carl Kurt Walther, et al

It is certified that error appears in the above–identified patent and that said Letters Patent are hereby corrected as shown below:

Column 2, Line 51, "housing" should read --having--

Signed and Sealed this

*Thirty-first* Day of *July 1984*

[SEAL]

*Attest:*

GERALD J. MOSSINGHOFF

*Attesting Officer*

*Commissioner of Patents and Trademarks*